United States Patent [19]

Bernstein

[11] Patent Number: 4,936,582

[45] Date of Patent: Jun. 26, 1990

[54] GOLF CLUB

[76] Inventor: Kenneth Bernstein, 96 Arapaho Trail, Branchburg, N.J. 08876

[21] Appl. No.: 316,138

[22] Filed: Feb. 24, 1989

[51] Int. Cl.[5] ..... A63B 53/02; A63B 53/10

[52] U.S. Cl. ..... 273/162 R; 273/78; 273/77 A; 273/80 B; 273/81 R; 273/DIG. 8; 273/167 R; 273/80.2; 272/8 N

[58] Field of Search ..... 273/80 B, DIG. 8, 77 R, 273/80.2, 77 A, 78, 81 R, 167 R; 272/8 N

[56] References Cited

U.S. PATENT DOCUMENTS

| | | | |
|---|---|---|---|
| 1,662,712 | 3/1928 | Mensing | 273/80 B |
| 3,121,945 | 2/1964 | Sauber | 273/67 A |
| 4,079,936 | 3/1978 | Schachter | 273/DIG. 8 |

*Primary Examiner*—George J. Marlo
*Attorney, Agent, or Firm*—Robert J. Ferb

[57] ABSTRACT

This invention is comprised of a golf club molded in a single piece including grip, shaft and head, preferably in the form of a putter or a wedge or in an alternative embodiment a golf club employing a flexible plastic shaft with a conventional grip and club head. These clubs are molded out of rubber or a flexible plastic material with appropriate physical properties to approximate the appearance and feel of a conventional golf club. However, the characteristics of rubber or rubber like material permit the club to be bent, twisted or deformed by violent contact with the ground or other objects. The material of construction permits a club after such distortion to be returned to its initial shape. These characteristics are designed primarily to permit a frustrated golfer to vent his feelings of frustration or dissatisfaction in a way that is non-destructive of his equipment. The preferred material for the molded club or the shaft is either polyurethane of 75 durometer; Shore D rating or natural rubber of 70 durometer Shore A rating, each with 2000 psi tensile strength.

6 Claims, 2 Drawing Sheets

FIG. 3
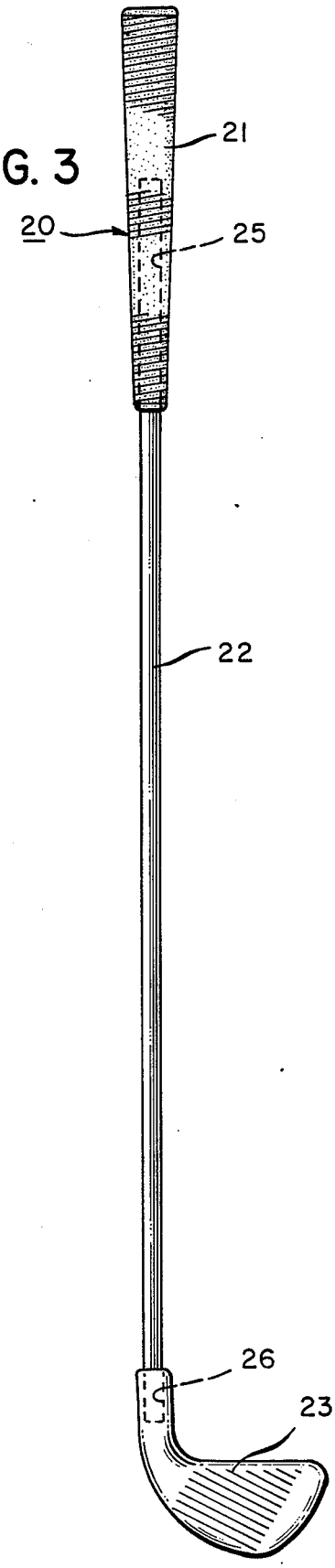
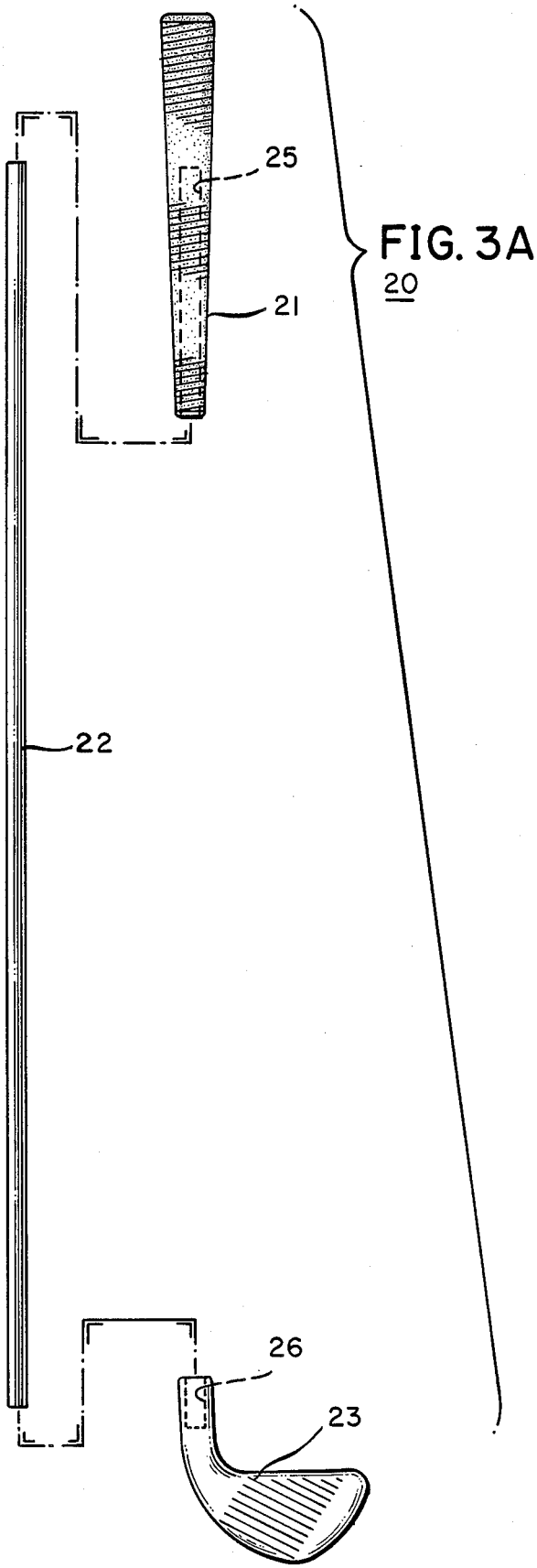
FIG. 3A
20

GOLF CLUB

BACKGROUND OF THE INVENTION

This invention relates to the general field of novelty golf clubs and more particularly relates to putters and wedges which can be bent and readily restored to a straight condition. This invention is comprised of a one piece club molded out of appropriate rubber or other polymeric material or a club with a flexible plastic shaft to which is attached a conventional grip and club head. This invention can be distinguished from other previous inventions pertaining to the field of golf and novelty golf clubs. For example, Pond in U.S. Pat. No. 3,087,728 describes a breakable simulated golf club which incorporates a frangible pin contained within the shaft which breaks, leaving the balance of the club intact. The Pond club is repaired by removing the broken parts of the frangible pin and replacing it with a new one. McLaughlin in U.S. Pat. No. 3,206,205 describes another embodiment of a breakable golf club in which a wooden dowel fractures when the club is grasped and broken in half. The broken part of this dowel is then removed; the unbroken part moved into the threaded coupling. The threaded coupling is constructed in such a way as to permit the threads to disengage when force is applied to break the club in half. The present invention, a club with a flexible but straightenable shaft, provides for more varied modes of venting one's frustration over a poorly made golf shot than breaking the club in half because of the characteristics of the club shaft.

It is therefore an object of the present invention to provide a one piece molded novelty gold club which can be used by a frustrated golfer to relieve his frustration and tension after having missed a shot without causing destruction of one of the golfer's regular clubs.

It is a further object of this invention to provide a flexible club which can be bent manually or bent by impacting it on the ground or a tree or other such object to vent one's frustration.

It is a further object of this invention to provide a novelty golf club which after its use and venting one's frustration can be restored to its original shape without the necessity of reassembly or the insertion of, or addition of, any breakable parts.

It is the further object of this invention to provide a novelty golf club which, when used in its intended manner, is unlikely to cause damage to the objects which it is applied because of the flexible nature of the material from which it is made.

It is a further object of this invention to provide a novelty golf club which uses a conventional grip and head with a flexible shaft which can be bent manually or bent by impacting it on the ground or a tree or other such object to vent one's frustration. After its use and after venting one's frustration the club can be restored to its original shape without the necessity of reassembly or the insertion of, or addition of, any breakable parts.

DESCRIPTION OF DRAWINGS

The invention will be described in detail by reference to the following drawings:

FIGS. 3 and 3A are descriptions of an embodiment of the club in which a conventional grip and head are affixed to a flexible shaft.

DESCRIPTION OF THE PREFERRED EMBODIMENT

Figure 1:
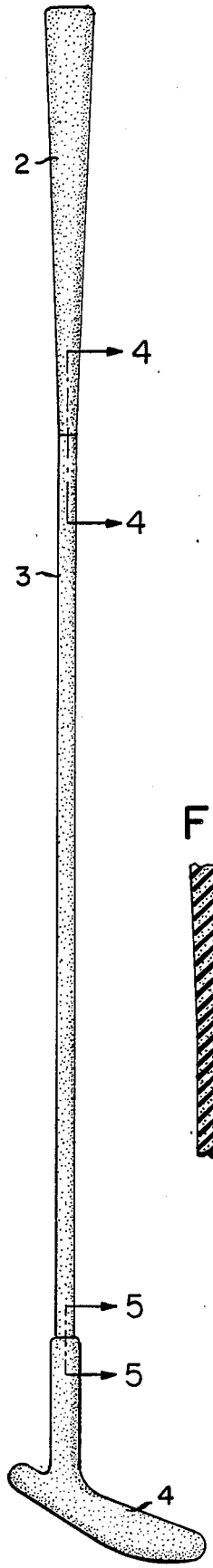
FIG. 1 is a view of the club in its configuration as a putter.
Figure 2:
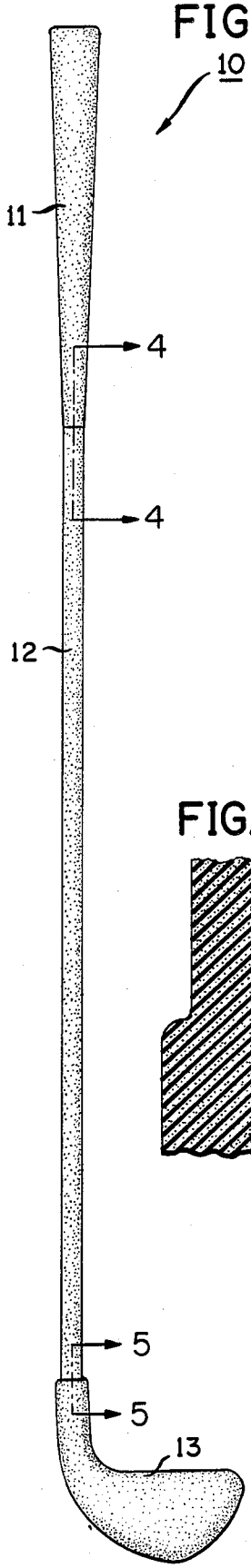
FIG. 2 is a description of the club in its configuration as a wedge.
Figure 4:
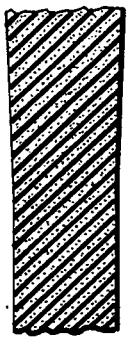
FIG. 4 is a cross section of the grip and shaft illustrating the one piece molded construction of the preferred embodiment seen along line 4—4 of FIGS. 1 and 2.
Figure 5:
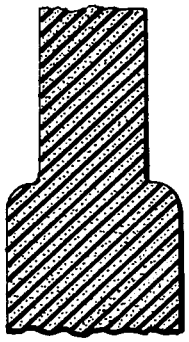
FIG. 5 is a cross section of the head and shaft illustrating the one piece molded construction of the preferred embodiment seen along line 5—5 of FIGS. 1 and 2.

This invention as shown in FIG. 1 is comprised of golf club 1, preferably in the form of a putter as shown in FIG. 1, which has an integrally molded grip 2, shaft 3 and putting head 4. In the preferred embodiment, club 1 is molded from cast high impact extra-hard polyurethane with a 75 durometer, Shore D rating and approximately 2000 pound per square inch tensile strength. While this is the preferred material, and a cylindrical shaft is preferred, other types of thermosetting materials, natural rubber or other plastic materials with similar physical properties are also contemplated. In FIG. 2, alternative club 10 includes grip 11 integral to shaft 12 and wedge-type head 13. Clubs 1 or 10 may be used as they are produced directly from the mold or they may be painted or otherwise changed in appearance to more closely resemble an actual club where the shaft 3 or 12 would be painted or coated to resemble a metal, graphite, or Fiberglas shaft. Head 4 or 13 could be molded to duplicate the shape and appearance of clubs made by particular manufacturers where such clubs have a distinctive shape, and painted or coated as required to duplicate the appearance of a regular club. It is also contemplated, within the scope of this invention, to incorporate directly into the material used for molding the club, coloring materials to simulate the appearance of a conventional club. The methods used for coloring, painting or coating the clubs 1 and 10 as described herein are well known in the art dealing with production of molded rubber and/or thermosetting and/or plastic materials.

FIG. 3 depicts an alternative embodiment of the invention which shows club 20. Club 20 is comprised of Grip 21, which may be a conventional golf club grip, containing cavity 25. One end of flexible shaft 22, is fixedly inserted into cavity 25 in grip 21 and the other end is fixedly inserted into cavity 26 in head 23. Head 23 can be a facsimile of a conventional club head or an actual club head. In all embodiments the overall length of the club is preferably 36 inches although longer or shorter lengths comparable to those for conventional golf clubs are contemplated.

In the preferred embody of club 20 shaft 12 is $\frac{5}{8}''$ diameter cast high impact extra-hard polyurethane having a 75 durometer Shore D rating and approximately 2000 psi tensile strength. Shafts of the preferred polyurethane of smaller or larger diameters may be used. A minimum diameter of $\frac{3}{8}''$ and a maximum diameter of $\frac{3}{4}''$ is suggested. Not by way of limitation but by the lack of adequate rigidity for smaller diameter and the lack of sufficient flexibility for larger diameters. This invention also contemplates the use of natural rubber with a 70 durometer shore a rating with approximately 2000 psi tensile strength.

It is understood that the description of the within invention is intended to describe the preferred embodiments of the invention and has been chosen for the purposes of illustration; however, it should be recognized that various changes such as simulating other types of clubs may be made without departing from the scope of the invention which is set forth in the claims herein below.

What is claimed is:

1. A golf club which is comprised of a handle, a shaft, and a head, all molded together from an appropriate flexible material, said club having structural characteristics corresponding to those resulting from being molded out of either natural rubber having a 70 durometer, Shore A rating, or high impact extra-hard polyurethane of 75 durometer Shore D rating, each with a 2,000 psi tensile strength, so that said club has sufficient rigidity to be used to play the game of golf and sufficient flexibility to restore its shape after having been bent to vent one's frustration.

2. A golf club as recited in claim 1 wherein said club is a putter.

3. A golf club as recited in claim 1 wherein said club is a wedge.

4. A golf club which is comprised of a flexible shaft to which at one end a grip is fixedly attached and at the other end a head is fixedly attached, the structural characteristics of said shaft corresponding to those resulting from being molded out of either high impact extra-hard polyurethane having a 75 durometer Shore D rating, or natural rubber having a 70 durometer Short A rating, each with an approximately 2000 psi tensile strength, so that said club has sufficient rigidity to be used to play the game of golf and sufficient flexibility to restore its shape after having been bent to vent one's frustration.

5. A golf club as recited in claim 4 wherein said shaft is approximately $\frac{5}{8}$ inch in diameter.

6. A golf club which is comprised of a flexible shaft to which at one end a grip is fixedly attached and at the other end a head is fixedly attached, the structural characteristics of said shaft corresponding to those resulting from being molded out of natural rubber of 70 durometer shore A rating with approximately 2000 psi tensile strength so that said club has sufficient rigidity to be used to play the game of golf and sufficient flexibility to restore its shape after having been bent to vent one's frustration.

* * * * *